US006648591B2

(12) United States Patent
Collins

(10) Patent No.: US 6,648,591 B2
(45) Date of Patent: Nov. 18, 2003

(54) TIP TREATMENT ASSEMBLY FOR A GAS TURBINE ENGINE

(75) Inventor: Larry Collins, Caldicot (GB)

(73) Assignee: Rolls-Royce PLC, London (GB)

( * ) Notice: Subject to any disclaimer, the term of this patent is extended or adjusted under 35 U.S.C. 154(b) by 0 days.

(21) Appl. No.: 10/085,025

(22) Filed: Mar. 1, 2002

(65) Prior Publication Data

US 2002/0122721 A1 Sep. 5, 2002

(30) Foreign Application Priority Data

Mar. 5, 2001 (GB) ..... 0105390

(51) Int. Cl.[7] ..... F01D 1/12
(52) U.S. Cl. ..... 415/58.5; 415/58.7
(58) Field of Search ..... 415/58.5, 58.7, 415/9, 119

(56) References Cited

U.S. PATENT DOCUMENTS 5,431,533 A 7/1995 Hobbs
5,474,417 A 12/1995 Privett et al.
6,409,470 B2 * 6/2002 Allford et al. ..... 415/119

FOREIGN PATENT DOCUMENTS

WO WO 94/20759 9/1994

* cited by examiner

*Primary Examiner*—Edward K. Look
*Assistant Examiner*—Kimya N McCoy
(74) *Attorney, Agent, or Firm*—Oliff & Berridge, PLC

(57) ABSTRACT

A tip treatment assembly is provided including a tip treatment bar (16) and retaining means (24, 26) which cooperate with a retaining element (30, 32) to retain the tip treatment bar (16) with respect to support means (44) of the assembly. The retaining means (24, 26) may comprise a hole through the bar (16) through which the retaining element, in the form of wire 30, 32, extends. The tip treatment bars (16) can be formed by stamping from a sheet of material such as a suitable alloy.

17 Claims, 4 Drawing Sheets

TIP TREATMENT ASSEMBLY FOR A GAS TURBINE ENGINE

FIELD OF THE INVENTION

This invention relates to a tip treatment assembly for a gas turbine engine.

BACKGROUND OF THE INVENTION AND PRIOR ART

WO94/20759 discloses an anti-stall tip treatment means in a gas turbine engine, in which an annular cavity is provided adjacent the blade tips of a compressor rotor. The cavity communicates with the gas flow path through the compressor through a series of slots defined between tip treatment bars extending across the mouth of the cavity.

Such tip treatments are applicable to both fans and compressors of gas turbine engines, and their purpose is to improve the blade stall characteristics or surge characteristics of the compressor.

Known tip treatments comprise an annular assembly made up of a plurality of segments in which the slots are formed. These segments are provided with tangs which cooperate with slots in the engine casing to hold the segments in position. The assembly may have more than 100 milled slots, and consequently manufacture is expensive and it is difficult to meet the required tolerances.

Experience has shown that tip treatment segments are likely to exhibit cracking due to vibration as the rotor blades pass the bars between the treatment slots defined between the tip treatment bars and the subsequent interaction between adjacent bars of each segment, since these bars are integral with one another.

Another problem encountered with the prior art is the possible damage caused by a fractured tip treatment bar. Once broken, the remnants of the bar can be displaced from its original location and cause damage.

An object of the present invention is to avoid cracking of tip treatment segments in a gas turbine engine.

A further object of the present invention is to avoid interaction between adjacent tip treatment bars.

A third object of the present invention is to retain fragments of a broken tip treatment bar to prevent further damage.

SUMMARY OF THE PRESENT INVENTION

According to the present invention there is provided a tip treatment assembly comprising a tip treatment bar provided with retaining means. The retaining means of the tip treatment bar cooperates with a retaining element to retain the tip treatment bar with respect to support means of the assembly.

The retaining means may comprise a hole through the bar, through which the retaining element extends. The retaining element may extend through an annular cavity which may be provided by the support.

A common retaining element may cooperate with the retaining means of a plurality of tip treatment bars, and may cooperate with all tip treatment bars in the assembly. Alternatively a separate retaining element may be provided for each tip treatment bar.

The retaining element may be a wire. The retaining means may be provided at one or both end regions of the tip treatment bar.

The tip treatment bars may be formed by stamping from a sheet of material such as a suitable alloy, in which case each bar will have a substantially uniform width corresponding to the thickness of the sheet.

An end region of the bar may be located within a recess provided in the support means, and damping material may be provided within the recess to provide additional damping of vibrations in the bar.

DETAILED DESCRIPTION OF A PREFERRED EMBODIMENT

Figure 1:
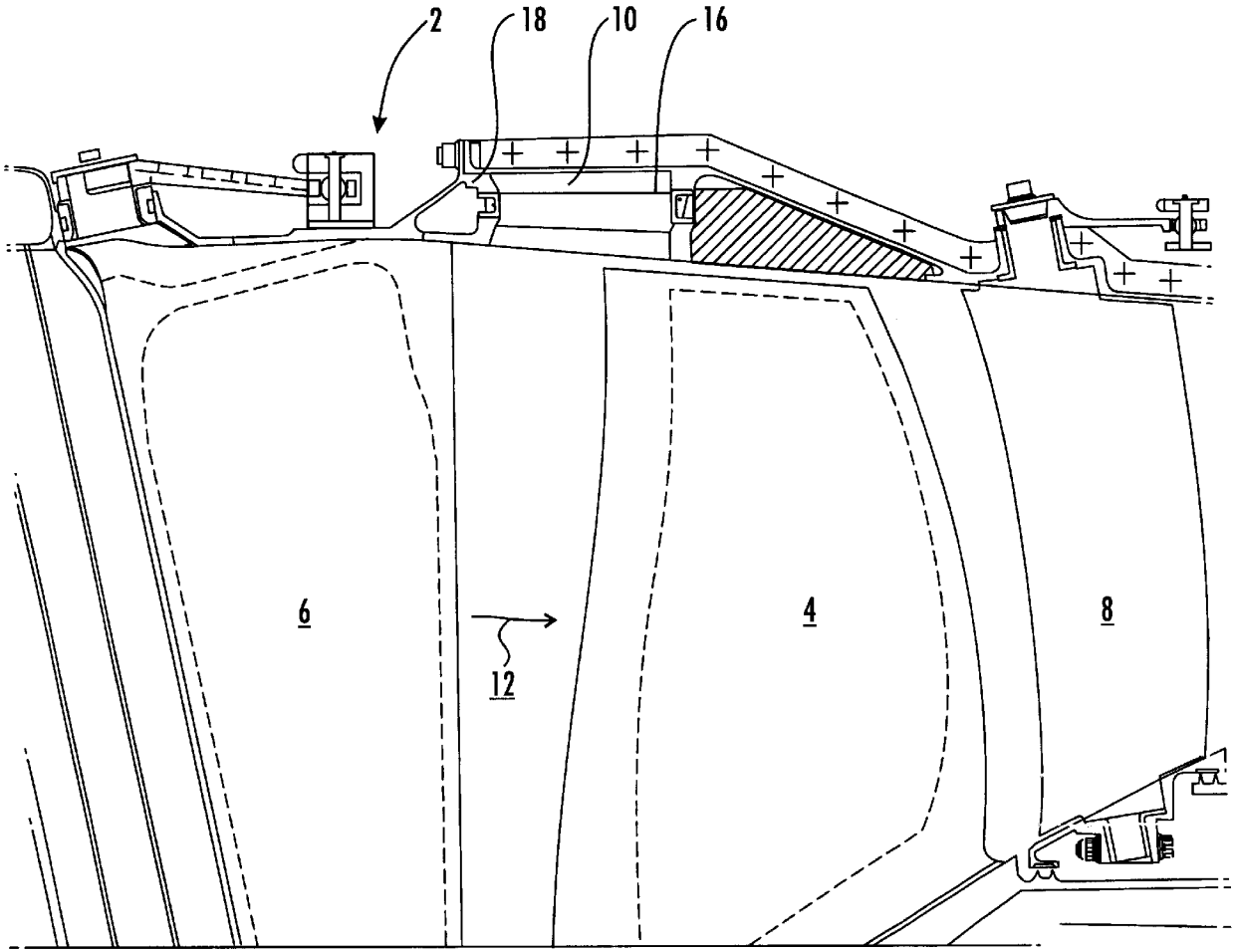
FIG. 1 is a partial axial sectional view of a fan stage in a gas turbine engine.

FIG. 1 represents a fan casing 2 of a gas turbine engine. A fan, represented by a single blade 4, is mounted for rotation in the casing 2. Guide vanes 6 and 8 are provided upstream and downstream, respectively, of the fan 4. The casing 2 includes a circumferentially extending chamber 10, which communicates with the main gas flow through the fan (represented by an arrow 12) through an array of slots defined between tip treatment bars 16 disposed around the casing. The function of the chamber 10 in delaying the onset of stalling of the blades 4 is disclosed in International Patent Publication WO94/20759.

Figure 4:
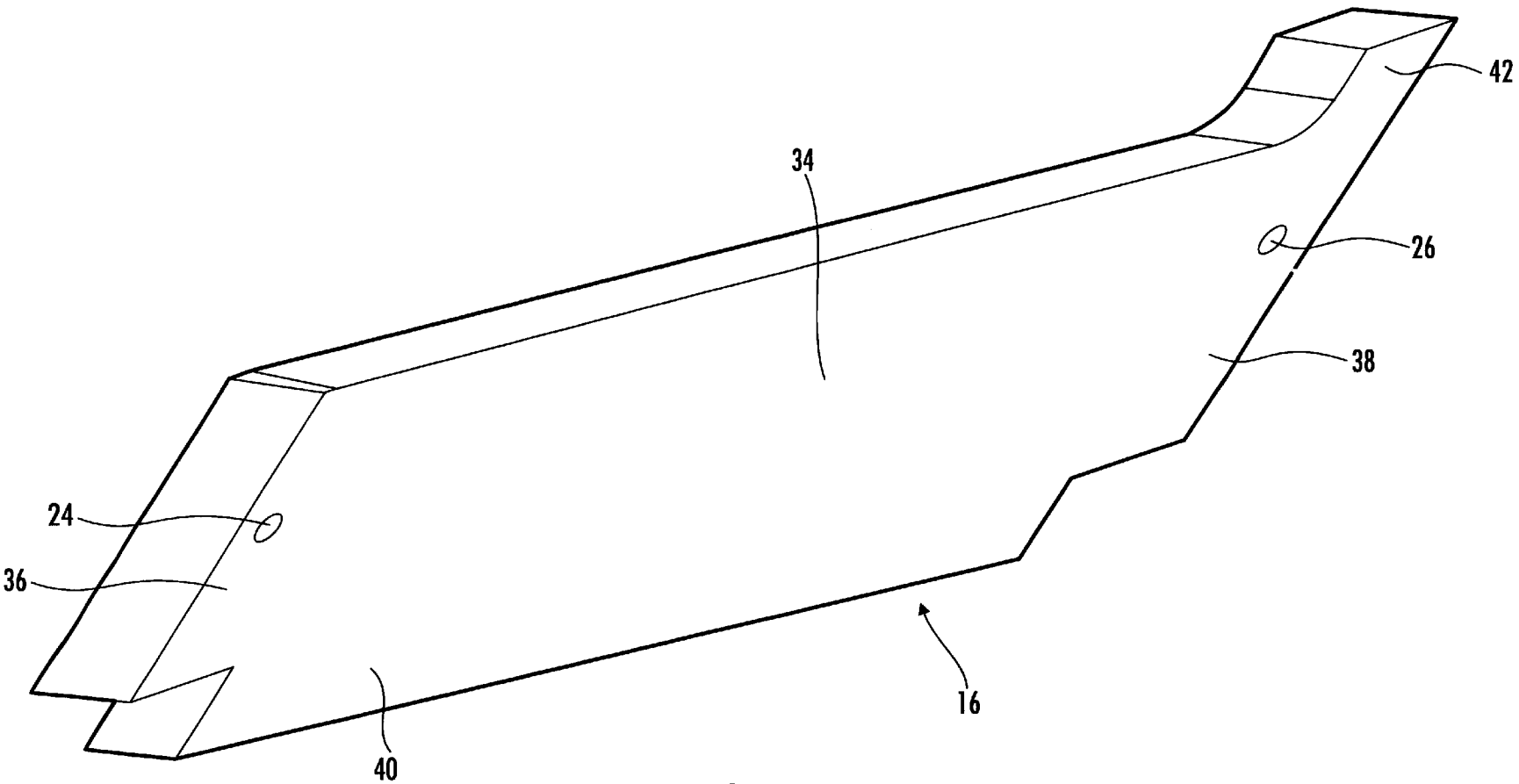
FIG. 4 shows a tip treatment bar.

Each tip treatment bar 16 (FIG. 4) comprises a body region 34 and front and rear end regions 36, 38. The body region has a lower portion 40 which depends below the end regions 36, 38. The upper edge of the front end region 36 is a continuation of the upper edge of the body portion 34 but the rear end region 38 has an upwardly extending projection 42.

Each end region has retaining means in the form of a circular through hole 24, 26.

Figure 3:
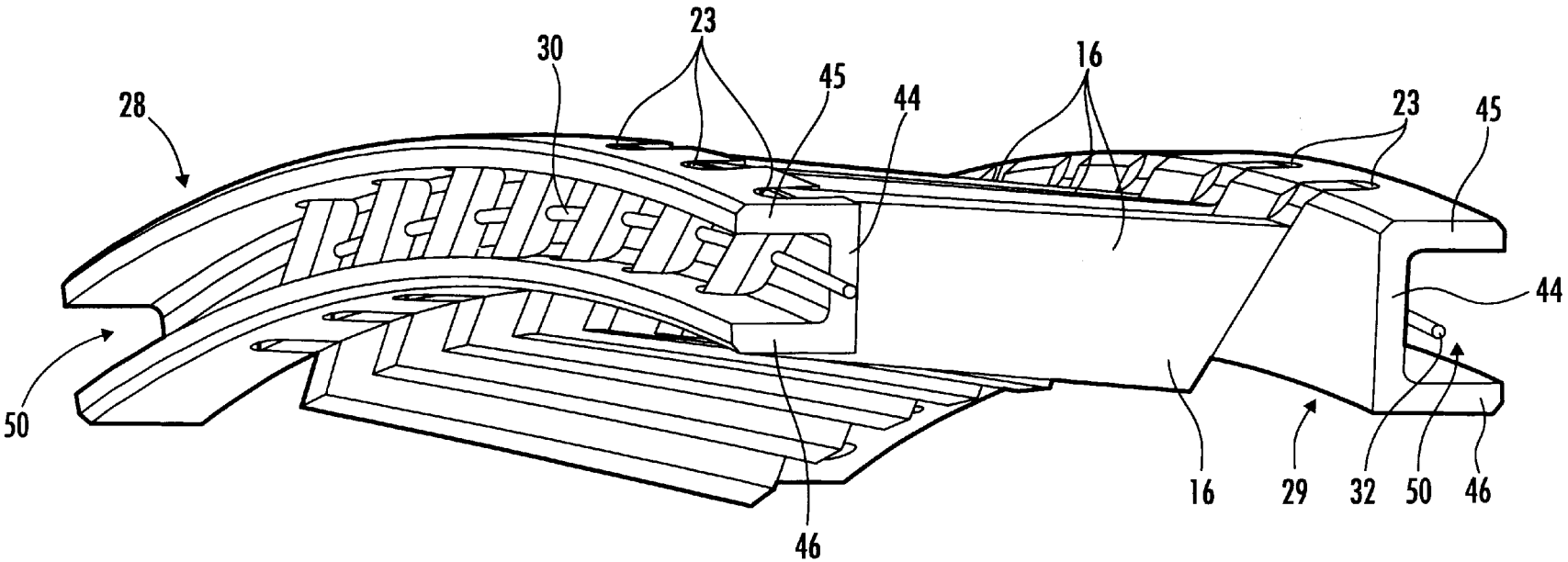
FIG. 3 is a view of a plurality of tip treatment bars in the fan stage shown in FIGS. 1 and 2.

The tip treatment bars 16 are supported by support means (FIG. 3) in the form of front and rear rings 28, 29. The rings 28, 29 may each be divided along a plane containing the engine centreline, both for assembly purposes and to allow for circumferential expansion of the rings. The rings 28, 29 are of channel-shaped cross-section, comprising a web 44 and two parallel limbs 45, 46. The rings 28, 29 are disposed with their webs 44 facing towards each other. Slots 23 are formed in the rings 28, 29, these slots extending through the webs 44 and part of the way along each limb 45, 46.

The end regions 36, 38 of each tip treatment bar 16 is located in a respective slot 23 in each ring 28, 29. The shape of each end region 36, 38 is such that the upper and lower edges of the end regions lie substantially flush with the upper and lower faces of the rings 28, 29, the lower portion 40 of the body depending below the lower faces of the rings 28, 29.

The holes 24, 26 are exposed within the channel 50 of each ring, adjacent the web 44. A retaining element in the form of a circumferentially extending circular wire 30, 32 passes through the holes 24 and 26 respectively. The wires 30, 32 thus retain the tip treatment bars in the longitudinal direction.

Figure 2:
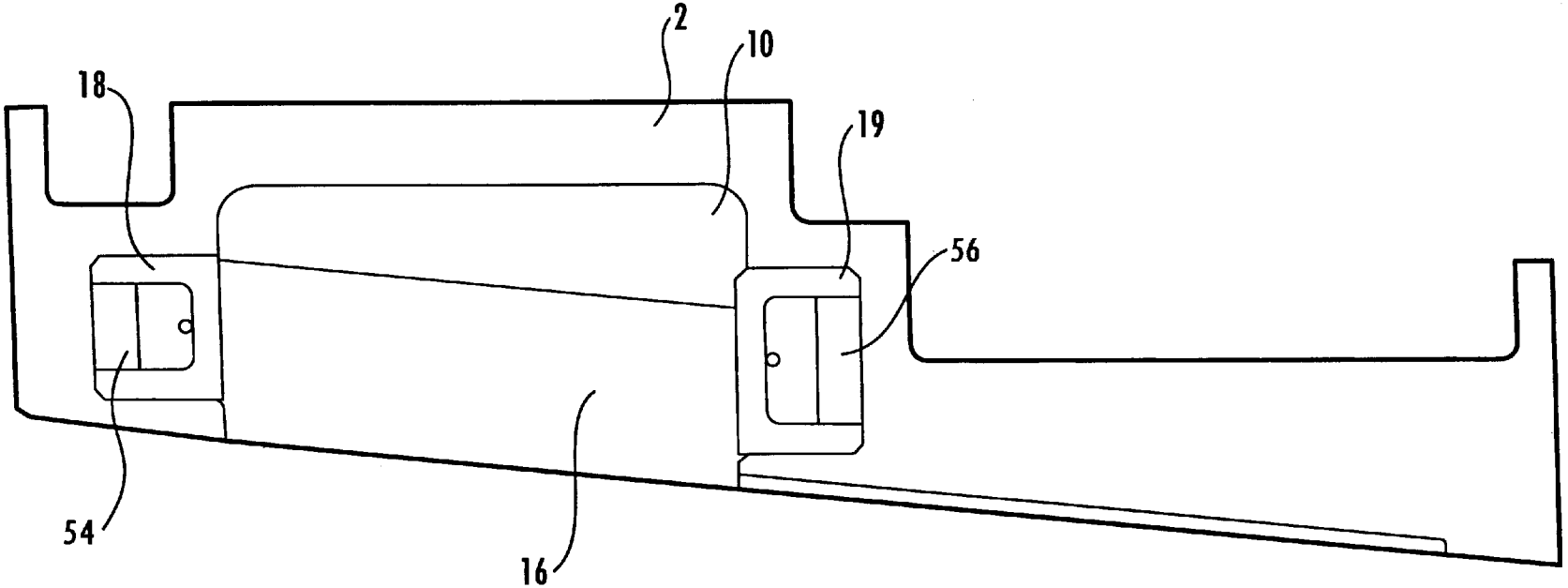
FIG. 2 is an enlarged view of part of the fan stage of FIG. 1.

As will be appreciated from FIG. 2, the rings 28, 29 are accommodated in annular recesses 18, 19 provided in the casing 2. Thus, the walls of the slots 23 serve to retain the bars 16 circumferentially. The wires 30, 32 contact the webs 44 to minimise longitudinal play between the bars 16 and the rings 28, 29. A visco elastic damping material 54, 56 (FIG. 2) is provided within the end rings 18, 19, containing the ends of the bars 16. The damping material 54, 56 is shielded from the skin temperature of the tip treatment assembly, and so is protected from erosion.

The bars 16 are made individually from a flat plate of a suitable alloy, and so have a uniform thickness along their length. They may be made from other materials, such as composite materials.

In operation of the engine, vibrations are set up in the tip treatment bars 16 as the fan blades 4 move past them. However, since the bars are not integrally connected to each other, the transmission of vibration between the bars, and to the rings 28, 29 is substantially reduced. The likelihood of fatigue fracture is therefore also reduced.

The damping material 54, 56 and the friction between the end regions 36, 38 and the slots 23 serve to damp the vibrations, thus further reducing the likelihood of fatigue fracture.

If a fragment of a disintegrated blade fractures a tip treatment bar 16, the end portions of the bar will be retained by the wires 30, 32, this reducing free debris within the engine.

I claim:

1. A tip treatment assembly comprising:

support means;

at least one tip treatment bar supported by the support means;

retaining means on the tip treatment bar; and a retaining element which cooperates with the retaining means to retain the tip treatment bar with respect to the support means.

2. A tip treatment assembly as claimed in claim 1, wherein the retaining means comprises a hole through the bar, through which the retaining element extends.

3. A tip treatment assembly as claimed in claim 1, wherein the support means has an annular cavity within which the retaining element is situated.

4. A tip treatment assembly as claimed in claim 1, wherein a common retaining element cooperates with the retaining means of a plurality of the said tip treatment bars.

5. A tip treatment assembly as claimed in claim 4, wherein a common retaining element cooperates with all of the tip treatment bars of the assembly.

6. A tip treatment assembly as claimed in claim 1, wherein a separate retaining element is provided for each tip treatment bar.

7. A tip treatment assembly as claimed in claim 1, wherein the retaining element comprises wire.

8. A tip treatment assembly as claimed in claim 1, wherein the retaining means is provided at an end region of the tip treatment bar.

9. A tip treatment assembly as claimed in claim 8, wherein a respective retaining means is provided at each end of the tip treatment bar.

10. A tip treatment assembly as claimed in claim 8, wherein the end region of the bar is located within a recess provided in the support means.

11. A tip treatment assembly as claimed in claim 10, wherein damping material is provided within the recess adjacent the end region of the or each bar.

12. A tip treatment assembly as claimed in claim 1, wherein the or each tip treatment bar has a uniform transverse dimension throughout its length.

13. In a gas turbine engine, a tip treatment assembly comprising:

support means;

a plurality of tip treatment bars supported by the support means;

retaining means on the tip treatment bar; and a retaining element which cooperates with the retaining means to retain the tip treatment bar with respect to the support means.

14. A tip treatment assembly as claimed in claim 13, in which the support means comprises oppositely disposed annular supports, and in which a plurality of the said tip treatment bars are supported at their ends by the annular supports.

15. A tip treatment assembly as claimed in claim 14, in which each annular support comprises a plurality of arcuate segments, each segment supporting a plurality of the tip treatment bars.

16. A tip treatment assembly as claimed in claim 13, in which each annular support comprises a web provided with circumferentially spaced apertures, and in which each tip treatment bar has a central region and opposite end regions, the end regions extending through respective apertures in the annular supports, the retaining means of each tip treatment bar comprising a hole extending through each end region of the bar, the holes being situated on the side of the respective web opposite the side on which the central region of the respective bar is situated, the retaining element comprising a common wire at each annular support which extends through the respective holes in the end regions of the bars.

17. A tip treatment bar comprising:

a central region;

opposite end regions; and a hole extending through the bar at each end region, the bar having a common transverse dimension throughout its length.

* * * * *